US009631391B2

(12) United States Patent
Ichikawa et al.

(10) Patent No.: US 9,631,391 B2
(45) Date of Patent: Apr. 25, 2017

(54) BUCKLING RESTRAINED BRACE AND LOAD-BEARING STRUCTURE PROVIDED WITH THE SAME

(71) Applicant: NIPPON STEEL & SUMIKIN ENGINEERING CO., LTD., Tokyo (JP)

(72) Inventors: Yasushi Ichikawa, Tokyo (JP); Kouhei Higuchi, Tokyo (JP); Kohji Nishimoto, Tokyo (JP); Nobuhiro Mochizuki, Tokyo (JP); Masatoshi Wada, Tokyo (JP); Toyoki Kuroiwa, Tokyo (JP); Shunji Endo, Tokyo (JP)

(73) Assignee: NIPPON STEEL & SUMIKIN ENGINEERING CO., LTD, Tokyo (JP)

( * ) Notice: Subject to any disclaimer, the term of this patent is extended or adjusted under 35 U.S.C. 154(b) by 254 days.

(21) Appl. No.: 14/124,791

(22) PCT Filed: Apr. 8, 2013

(86) PCT No.: PCT/JP2013/060613

§ 371 (c)(1),
(2) Date: Dec. 9, 2013

(87) PCT Pub. No.: WO2014/167624

PCT Pub. Date: Oct. 16, 2014

(65) Prior Publication Data

US 2015/0218838 A1 Aug. 6, 2015

(51) Int. Cl.
*E04H 9/02* (2006.01)
*E04H 9/00* (2006.01)

(52) U.S. Cl.
CPC ..... *E04H 9/021* (2013.01); *E04H 9/00* (2013.01); *E04H 9/024* (2013.01); *E04H 9/028* (2013.01)

(58) Field of Classification Search
CPC E04H 9/02; E04H 9/024; E04H 9/021; E04H 9/028; E04H 9/00; E04H 9/022; E04B 1/98
(Continued)

(56) References Cited

U.S. PATENT DOCUMENTS 7,065,927 B2 * 6/2006 Powell ..... E04H 9/02 403/174
7,185,462 B1 * 3/2007 Smelser ..... 52/167.3
(Continued)

FOREIGN PATENT DOCUMENTS

CA WO 2012094756 A1 * 7/2012 ..... E04H 9/022
CN 102877568 A 1/2013
(Continued)

OTHER PUBLICATIONS

International Search Report dated May 28, 2013 issued in corresponding PCT Application No. PCT/JP2013/060613 [With English Translation].
(Continued)

*Primary Examiner* — Phi A
(74) *Attorney, Agent, or Firm* — Andrews Kurth Kenyon LLP

(57) ABSTRACT

Provided are a buckling restrained brace including a core material that has a plate shape and extends along an axis, a restraining member that extends along the axis and covers the core material from an outer peripheral side in a state where both end portions of the core material in an axis direction protrude outside, a filler that is filled between the restraining member and the core material, and a pair of first reinforcing members that each have a plate shape and are installed in both end portions of the core material in the axis direction so as to interpose the core material therebetween from both sides of the core material in a plate width
(Continued)

direction, and a load-bearing structure installed with the buckling restrained brace.

2 Claims, 9 Drawing Sheets

(58) Field of Classification Search
USPC ..... 52/167.3, 167.1
See application file for complete search history.

(56) References Cited

U.S. PATENT DOCUMENTS

| | | | | |
|---|---|---|---|---|
| 7,647,734 | B2 * | 1/2010 | Sarkisian | E04H 9/02 187/406 |
| 2004/0206591 | A1 * | 10/2004 | Smelser | E04C 3/02 188/371 |
| 2006/0101733 | A1 * | 5/2006 | Jen et al. | 52/167.1 |
| 2007/0240368 | A1 * | 10/2007 | Tsai et al. | 52/167.3 |
| 2008/0250732 | A1 * | 10/2008 | Tsai | 52/167.3 |
| 2010/0005737 | A1 * | 1/2010 | Tsai | E04H 9/02 52/167.3 |
| 2011/0232221 | A1 * | 9/2011 | Tsai | E04H 9/021 52/656.9 |
| 2013/0205690 | A1 * | 8/2013 | Hinchman | E04H 9/02 52/167.3 |
| 2014/0059950 | A1 * | 3/2014 | Marinovic | E04H 9/024 52/167.3 |
| 2014/0150372 | A1 * | 6/2014 | Ueki | E04H 9/02 52/695 |

FOREIGN PATENT DOCUMENTS

| | | | | |
|---|---|---|---|---|
| JP | 03253675 | A * | 11/1991 | E04H 9/02 |
| JP | 04030046 | A * | 2/1992 | E04B 1/24 |
| JP | 4-19121 | | 4/1992 | |
| JP | 05071242 | A * | 3/1993 | E04H 9/02 |
| JP | 06057820 | A * | 3/1994 | E04B 1/24 |
| JP | 06212833 | A * | 8/1994 | E04H 9/02 |
| JP | 3621947 | | 2/2005 | |
| JP | 2010-168865 | | 8/2010 | |
| JP | 2011-058260 | | 3/2011 | |
| JP | 2011-169042 | | 9/2011 | |
| TW | 201132832 | A | 10/2011 | |

OTHER PUBLICATIONS

Office Action issued on Jul. 21, 2016, in corresponding Chinese Patent Application No. 201380002209.5 [with English Translation].

* cited by examiner

BUCKLING RESTRAINED BRACE AND LOAD-BEARING STRUCTURE PROVIDED WITH THE SAME

This application is a national stage application of International Application No. PCT/JP2013/060613, filed Apr. 8, 2013, the content of which is incorporated by reference in its entirety.

FIELD OF THE INVENTION

The present invention relates to a buckling restrained brace that absorbs an exciting force due to an earthquake or the like, and a load-bearing structure provided with the buckling restrained brace.

BACKGROUND ART

In recent years, a buckling restrained brace has been adopted as an axial member used as a brace, for example, of a building or a bridge structure. In the buckling restrained brace, a core material receiving an axial force is restrained from an outer peripheral side by a steel tube and concrete or mortar. Therefore, the buckling restrained brace is prevented from out-of-plane deformation or buckling and deforms plastically, thereby enhancing aseismic and vibration control performances of the building or the bridge structure.

An example of a buckling restrained brace is disclosed in Patent Literature 1, where buckling strength of a core material is improved by a first reinforcing member and a second reinforcing member.

RELATED ART DOCUMENT

Patent Document

[Patent Literature 1]

Japanese Unexamined Patent Application, First Publication No. 2010-168865

DISCLOSURE OF THE INVENTION

Problems to be Solved by the Invention

The buckling restrained brace disclosed in Patent Literature 1 enables improvement in buckling strength. However, the buckling restrained brace has a very complex structure in which a reinforcing material is welded to the periphery of the core material, and furthermore, the reinforcing material welded to the periphery of the core material is covered with other reinforcing materials from the outside thereof, thus, the cost is high.

The present invention provides a buckling restrained brace which suppresses the cost increase and enables an improvement in yield strength and buckling strength, and a load-bearing structure provided with the buckling restrained brace.

Means for Solving the Problem

A buckling restrained brace according to a first aspect of the present invention includes a core material that extends along an axis and has a plate shape, a restraining member that extends along the axis and covers the core material from an outer peripheral side in a state where both end portions of the core material in an axis direction protrude outside, a filler that is filled between the restraining member and the core material, and a pair of first reinforcing members that each have a plate shape and are attached on both end portions of the core material in the axis direction so as to interpose the core material therebetween from both sides of the core material in a plate width direction.

According to the buckling restrained brace described above, the first reinforcing member is attached on the end portion of the core material. Therefore, the cross-sectional area at a position on the end portion side can be widened, and thus it is possible to improve the axial strength and the bending strength of the core material. Furthermore, it is sufficiently adequate to simply attach the plate-shaped first reinforcing member on the core material, and thus it is easy to manufacture.

Additionally, in the buckling restrained brace according to a second aspect of the present invention, a pair of the core materials may be provided in a state of being positioned away from each other in a plate thickness direction. The buckling restrained brace may further include second reinforcing members that are disposed between the pair of the core materials at both end portions of the core materials in the axis direction, thereby connecting the pair of the core materials.

As described above, a load can be received by the pair of the core materials and the second reinforcing member is provided between the core materials. Therefore, it is possible to further improve the axial strength and the bending strength at end portions of the core materials.

Furthermore, a load-bearing structure according to a third aspect of the present invention includes a frame of which an external form has a rectangular frame shape, a plurality of mounting members provided so as to protrude inward from the frame, and a buckling restrained brace according to a first or second aspect that is installed between the mounting members opposite to each other, out of the plurality of the mounting members, wherein each of the mounting members is formed with slits that extend from end surfaces of the mounting members toward the frame, so that the pair of first reinforcing members is capable of being inserted therein when the buckling restrained brace is installed.

According to the load-bearing structure described above, the slit in which the first reinforcing member is capable of being inserted is formed on the mounting member. Therefore, it is possible to set the first reinforcing member on the mounting member from an out-of-plane direction of the frame, in a state where the mounting member is installed in the frame in advance.

Effects of the Invention

According to the buckling restrained brace of the first aspect, the first reinforcing member is attached on the core material. Thereby, it is possible to suppress the cost increase and improve yield strength and buckling strength at the position on the end portion side of the core material.

According to the buckling restrained brace of the second aspect, the pair of the core materials and the second reinforcing member are provided. Therefore, it is possible to further improve the yield strength and buckling strength at the positions on the end portion sides of the core materials.

According to the load-bearing structure of the third aspect, it is possible to easily install the buckling restrained brace in the frame using the slit on the mounting member. Thus, it is possible to reduce the number of man-days for construction by improved workability.

MODE FOR CARRYING OUT THE INVENTION

First Embodiment

Hereinafter, a buckling restrained brace 1 according to a first embodiment of the present invention will be described.

The buckling restrained brace 1 is used as a brace or the like in a building, a bridge structure or the like so as to improve aseismic and vibration control performances.

Figure 1A:
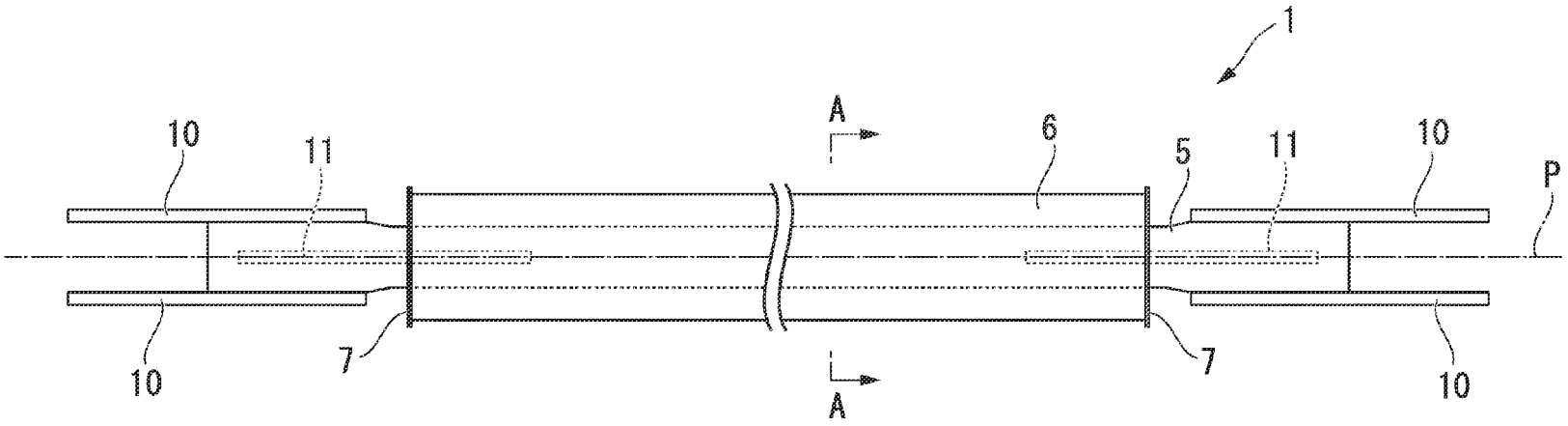
FIG. 1A is a side view of a buckling restrained brace according to a first embodiment of the present invention.
Figure 1B:
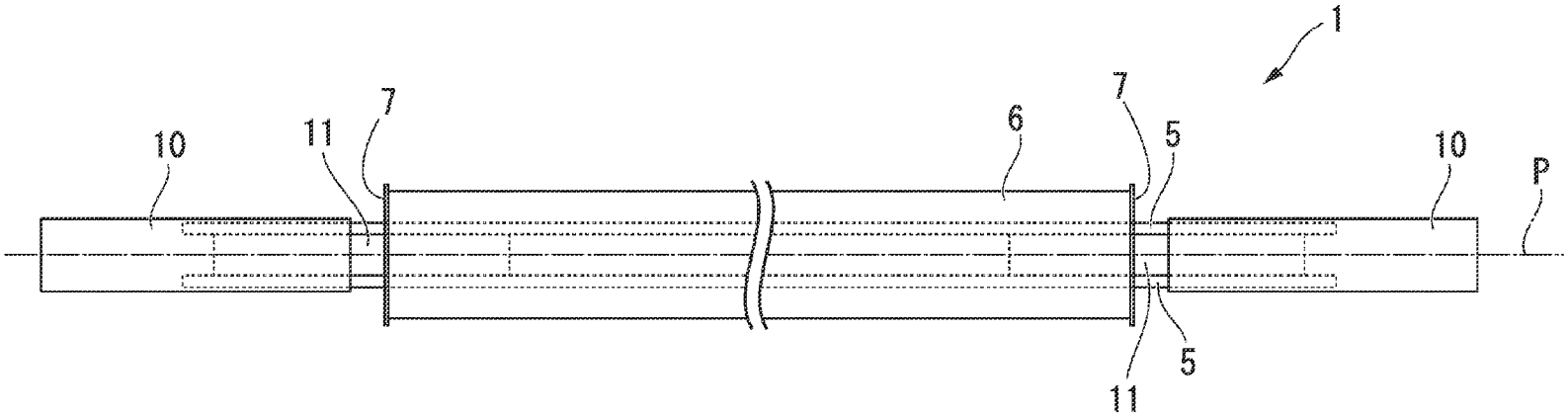
FIG. 1B is a top view of the buckling restrained brace according to the first embodiment of the present invention.

As shown in FIGS. 1A, 1B and IC, the buckling restrained brace 1 includes a pair of core materials 5 extending along an axis P, a restraining member 6 that covers the pair of core materials 5 from an outer peripheral side in a state where both end portions of the core materials 5 in an axis P direction protrude outside, and a filler 8 that is filled between the restraining member 6 and the pair of core materials 5.

Furthermore, the buckling restrained brace 1 includes a pair of end connection plates 10 (first reinforcing members) attached on the pair of core materials 5, and a bridge plate 11 (second reinforcing member) disposed between the pair of core materials 5.

As described above, the buckling restrained brace 1 is a dual-core plate type having two core materials 5.

The pair of core materials 5 extends along the axis P. Each of the core materials 5 has a plate shape. These core materials 5 are provided in a state of being positioned away from each other in a plate thickness direction thereof.

Figure 1C:
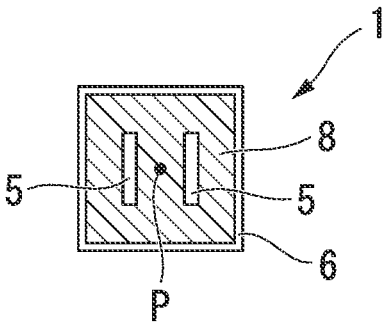
FIG. 1C is a view of a cross-section in the buckling restrained brace according to the first embodiment of the present invention that is perpendicular to an axis and taken along line A-A in FIG. 1A.

The restraining member 6 is formed of a steel tube. In this embodiment, the restraining member 6 has a square tube shape, as shown in FIG. 1C. However, the restraining member 6 may have a circular cylinder shape, for example. In addition, end portion lids 7 are provided on both end portions of the restraining member 6 in the axis P direction so as to close the openings. In the restraining member 6, the pair of core materials 5 is provided at a central position in the plate thickness direction and a plate width direction perpendicular to the plate thickness direction, in a state of penetrating the end portion lids 7 in the axis P direction.

The filler 8 is concrete, mortar or the like. The filler 8 restricts the deformation of the core materials 5 in a direction other than the axis P direction. Further, for preventing an axial force of the core materials 5 from being transmitted to the restraining member 6, the filler 8 holds the core materials 5 so as to enable the core materials 5 to move in the axis P direction relatively to the restraining member 6.

The pair of end connection plates 10 is attached on the core materials 5 at positions on both end portion sides of the core materials 5 in the axis P direction, such that the pair of end connection plates 10 interposes the pair of core materials 5 therebetween from both sides of the core materials 5 in the plate width direction. In other words, the end connection plates 10 are connected with the pair of core materials 5 at both sides in the plate width direction. Furthermore, each of the end connection plates 10 has a plate shape and is provided on an end portion of the core material 5 in the axis P direction so as to protrude in the axis P direction.

In this embodiment, these end connection plates 10 are provided on parts of the core materials 5 protruding to the outside of the restraining member 6. Therefore, the end connection plates 10 are disposed on the outside of the restraining member 6.

The bridge plates 11 are disposed between the pair of core materials 5, on both end portions of the core materials 5 in the axis P direction. Each of the bridge plates 11 is a plate-shaped member connecting the pair of core materials 5.

Further, the bridge plate 11 penetrates the end portion lid 7 in the axis P direction, in this embodiment. Thus, the bridge plate 11 is disposed over the inside and outside of the restraining member 6.

In the buckling restrained brace 1 described above, a load can be received by the pair of core materials 5, and also the cross-sectional area at a position on the end portion side of the core material 5 can be widened by attaching the end connection plate 10 on the end portion side of the core material 5. Thus, it is possible to improve the axial strength and the bending strength of the core material 5.

In addition, it is possible to improve an axial strength and a bending strength by simply attaching the end connection plate 10 on the core material 5 by welding or the like. Also, it is easy to manufacture.

Furthermore, the end connection plate 10 is disposed on the outside of the restraining member 6, in this embodiment. Thus, it is possible to more easily attach the end connection plate 10 on the core material 5.

Additionally, it is possible to improve the axial strength and the bending strength at the position on the end portion side of the core material 5, by the work of the bridge plate 11.

Here, in case that the end connection plate 10 is disposed over the inside and outside of the restraining member 6, it is necessary to secure some extent of covering thickness with respect to the filler 8. Thus, there is a problem in that an outer diameter of the restraining member 6 increases.

However, a dual-core type is adopted as the buckling restrained brace 1 in this embodiment, and thus it is possible to provide the bridge plate 11 in the buckling restrained brace 1. Thus, upon comparison with the case provided with a single core material 5, it is possible to increase the axial strength and the bending strength of the core materials 5. Therefore, it is possible to obtain the sufficiently adequate axial strength and bending strength even when the end connection plate 10 is not disposed over the inside and outside of the restraining member 6. As a result, it is possible to reduce the outer diameter of the restraining member 6 by disposing the end connection plate 10 outside of the restraining member 6. Thus, it is possible to save the material cost and space.

According to the buckling restrained brace 1 of this embodiment, the end connection plate 10 is attached on the core material 5. Therefore, it is possible to suppress the cost increase and improve yield strength and buckling strength of the end portion of the core material 5.

Further, in this embodiment, the bridge plate 11 is disposed over the inside and outside of the restraining member 6. However, without being limited to the configuration described above, the bridge plate 11 may be disposed only outside of the restraining member 6 or only inside the restraining member 6.

In addition, the end connection plate 10 may be disposed over the inside and outside of the restraining member 6.

Second Embodiment

Figure 2A:
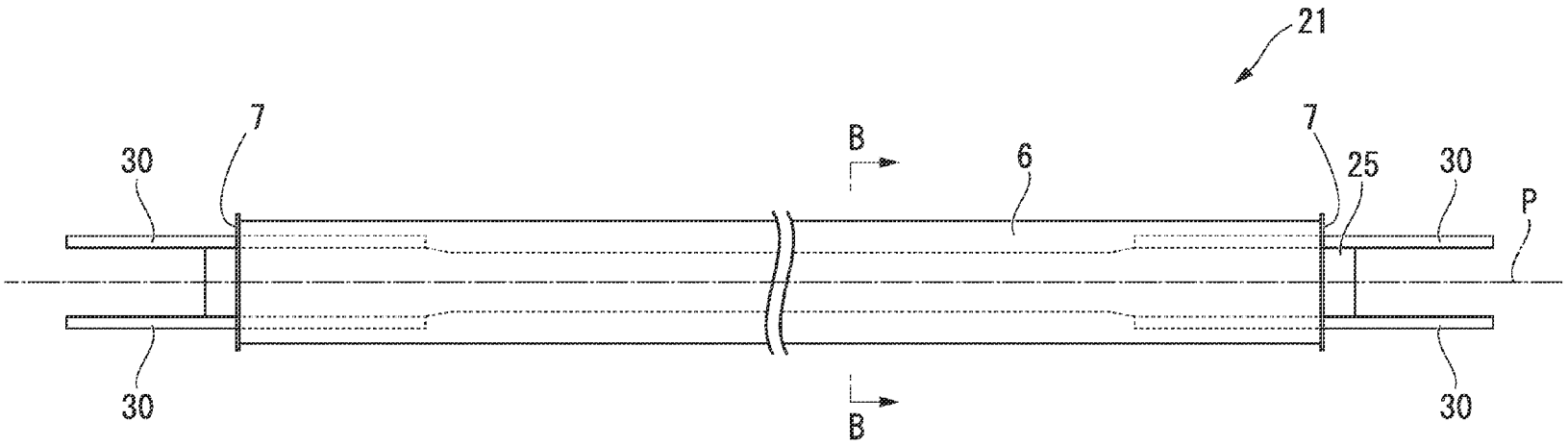
FIG. 2A is a side view of a buckling restrained brace according to a second embodiment of the present invention.
Figure 2B:
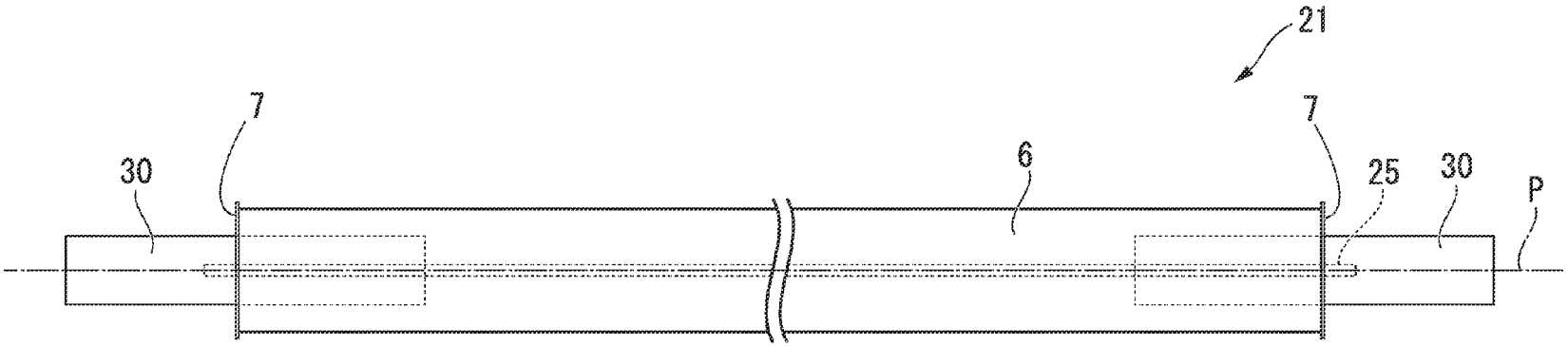
FIG. 2B is a top view of the buckling restrained brace according to the second embodiment of the present invention.

Subsequently, a buckling restrained brace 21 according to a second embodiment of the present invention will be described with reference to FIGS. 2A, 2B and 2C.

The same reference signs are given to the components common to those of the first embodiment. Further, the description thereof will not be repeated.

A single-core plate type provided with a single core material 25 is adopted as the buckling restrained brace 21 in this embodiment. In other words, the buckling restrained brace 21 of this embodiment is not provided with the bridge plate 11.

Figure 2C:
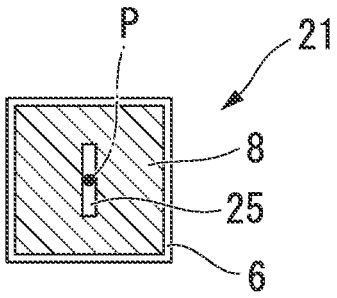
FIG. 2C is a view of a cross-section in the buckling restrained brace according to the second embodiment of the present invention that is perpendicular to the axis and taken along line B-B in FIG. 2A.

The core material 25 is provided in the restraining member 6 at a central position in the plate thickness direction and the plate width direction, as shown in FIG. 2C.

A pair of end connection plates 30 is approximately the same member as the end connection plates 10 of the first embodiment. In the second embodiment, the pair of end connection plates 30 is provided over the inside and outside of the restraining member 6 so as to penetrate the end portion lid 7.

According to the buckling restrained brace 21 of this embodiment, the cross-sectional area at the position on the end portion side of the core material 25 in the axis P direction can be widened by the pair of end connection plates 30. Thus it is possible to improve the axial strength and the bending strength of the core material 25. Thus, the buckling restrained brace 21 has a simple structure as described above, and therefore it is easy to manufacture. As a result, it is possible to suppress the cost increase and to improve yield strength and buckling strength of the end portion of the core material 25.

Further, in this embodiment, the end connection plate 30 is disposed over the inside and outside of the restraining member 6. However, without being limited to the configuration described above, the end connection plate 30 may be disposed only outside of the restraining member 6, similar to the first embodiment.

Figure 3:
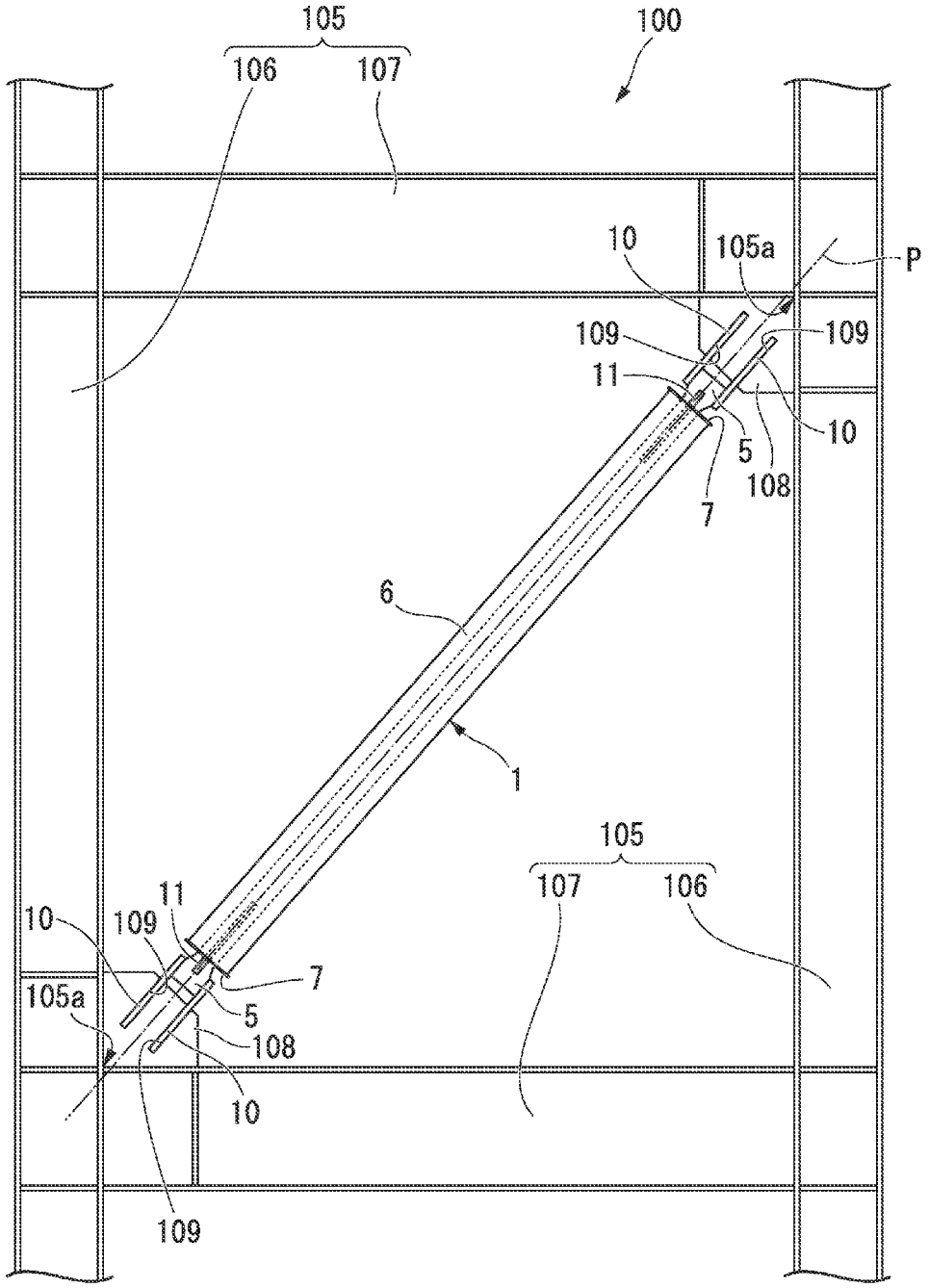
FIG. 3 is a side view showing a state in which the buckling restrained brace according to the first embodiment of the present invention is installed in a frame.
Figure 4:
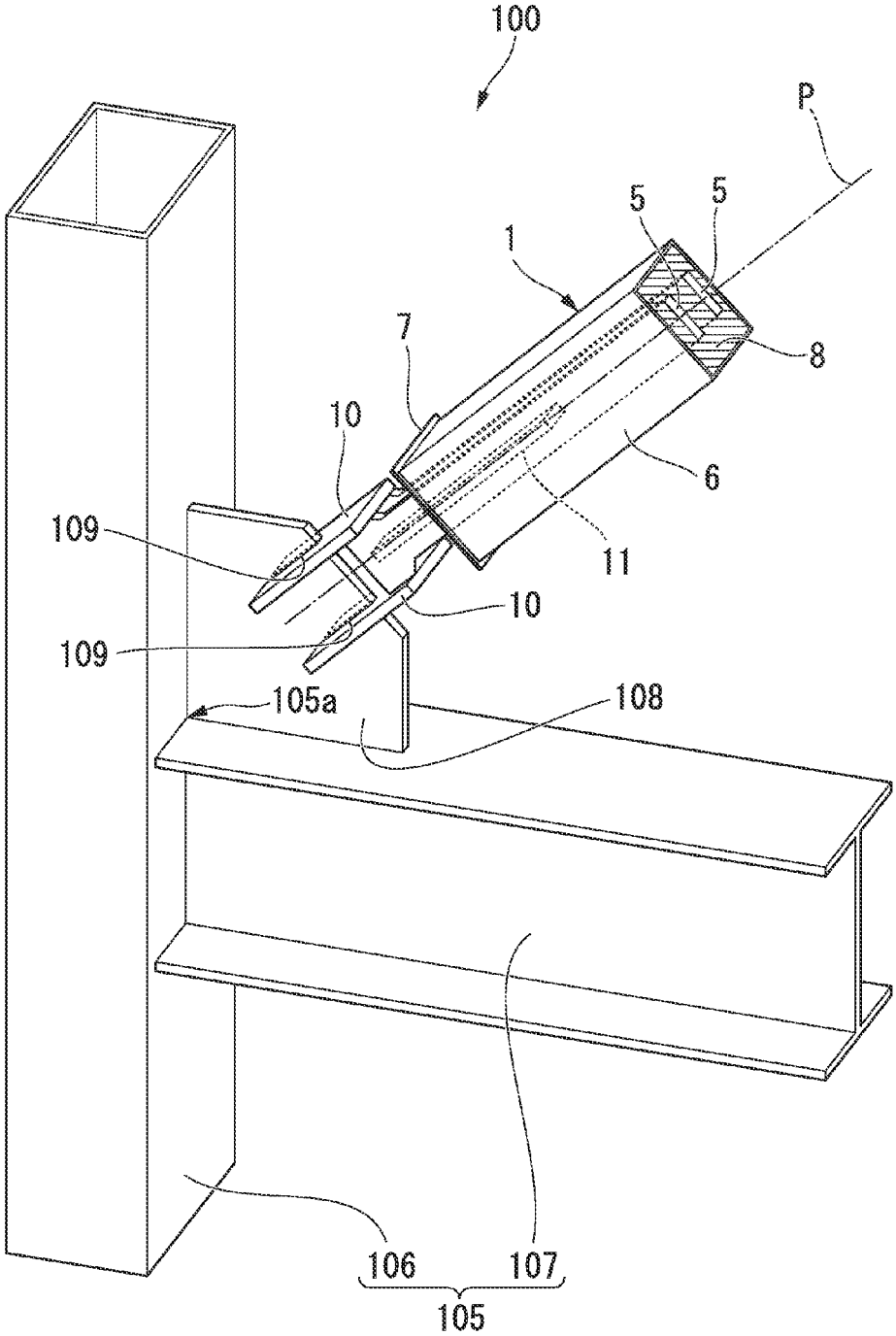
FIG. 4 is a perspective view showing a load-bearing structure in which the buckling restrained brace according to the first embodiment of the present invention is installed in the frame, and further the periphery of a gusset plate is enlarged in the view.

Next, a load-bearing structure 100 in which the buckling restrained brace 1 according to the first embodiment is installed will be described with reference to FIGS. 3 and 4.

The load-bearing structure 100 includes a frame 105 of which an external form has a rectangular frame shape, a gusset plate 108 (a mounting member) provided in each corner portion 105*a* of the frame 105, and the buckling restrained brace 1 installed in the frame 105 via the gusset plate 108.

The frame 105 has two vertical frames 106 which extend in an up-down direction and are disposed away from each other on right and left sides in a horizontal direction and two horizontal frames 107 each of which connects the vertical frames 106 at an up or down side. Further, the corner portion 105*a* is formed in a connection portion between the vertical frame 106 and the horizontal frame 107.

The gusset plate 108 is a plate-shaped member which is provided between the vertical frame 106 and the horizontal frame 107 in the corner portion 105*a* of the frame 105 so as to protrude obliquely upward (or downward) on the inside of the frame 105. In addition, the gusset plate 108 is joined to the vertical frame 106 and the horizontal frame 107 by welding or the like.

Furthermore, two slits 109 are formed on the gusset plate 108 so as to be disposed away from each other on up and down sides. The two slits 109 extend from an end surface of the gusset plate 108 directing obliquely upward toward the corner portion 105*a* of the frame 105. As described below, the two slits 109 are formed in a size in which the pair of end connection plates 10 is tightly inserted therein from the plate thickness direction of the core material 5 when the buckling restrained brace 1 is installed in the frame 105.

The buckling restrained brace 1 is installed between the two gusset plates 108 positioned on the diagonal of the frame 105, so as to connect the gusset plates 108. Further, the buckling restrained brace 1 is suspended such that the axis P thereof is inclined in the up-down direction and a right-left direction. In addition, the pair of end connection plates 10 is inserted in the pair of slits 109, in a state of facing inner surfaces of the slits 109 in the plate thickness direction. The pair of end connection plates 10 is joined to the gusset plate 108 by fillet welding, a bolt-fastened manner or the like. In other words, the buckling restrained brace 1, in a state before joining, is movable, relatively to the frame 105, in an out-of plane direction (the plate thickness direction of the core material 5) of the frame 105.

According to the load-bearing structure 100 described above, the slit 109 in which the end connection plate 10 is inserted is formed on the gusset plate 108. Therefore, it is possible to set the end connection plate 10 on the gusset plate 108 from the out-of-plane direction of the frame 105, in a state where the gusset plate 108 is provided in the frame 105 in advance. Thus, it is possible to easily install the buckling restrained brace 1 on the frame 105, and therefore it is possible to reduce the number of man-days for construction by improved workability.

Figure 5:
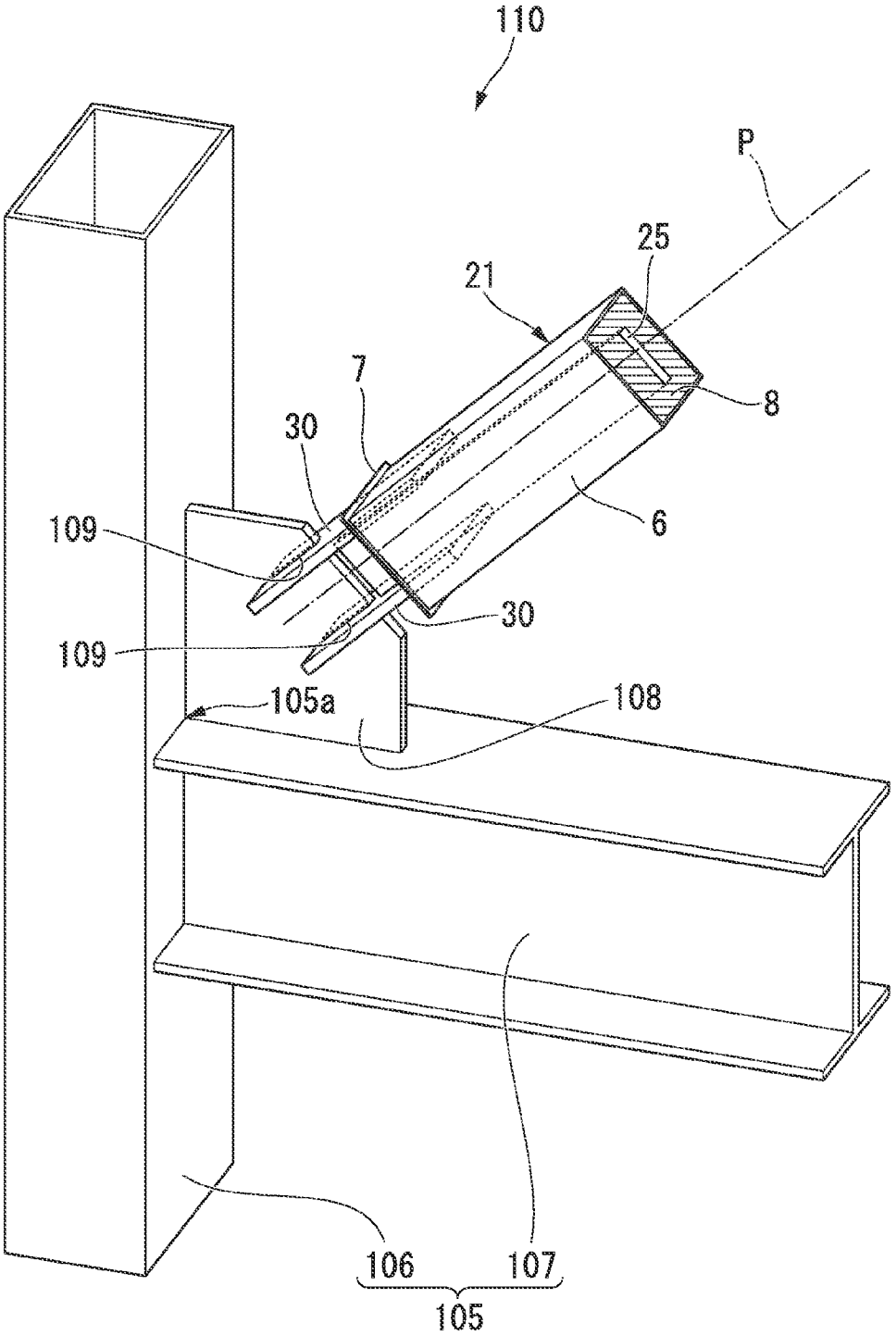
FIG. 5 is a perspective view showing a load-bearing structure in which the buckling restrained brace according to the second embodiment of the present invention is installed in the frame, and further the periphery of a gusset plate is enlarged in the view.

Here, the load-bearing structure 110 may be configured in a way such that the buckling restrained brace 21 of the second embodiment is installed in the frame 105, as shown in FIG. 5. Even in this case, it is also possible to easily install the buckling restrained brace 21 on the frame 105, and therefore it is possible to reduce the number of man-days for construction.

Furthermore, in the frame 105, a gusset plate may protrude from a central position of the vertical frame 106 and the horizontal frame 107 in an extending direction toward the inside of the frame 105. The frame 105 may include the gusset plate described above, and further the buckling restrained brace 1 or 21 may be installed between the gusset plates opposite to each other. That is, this embodiment is not limited to the case where the buckling restrained brace 1 or 21 is installed between the corner portions 105*a*.

Hereinbefore, the preferable embodiments of the present invention are described. However, the present invention is not limited to this embodiments described above. Additions, omissions, substitutions, and other modifications can be applied to the configurations as long as they do not depart from the scope of the present invention. The present invention is not limited by the description described above, but limited only by the scope of claims appended below.

INDUSTRIAL APPLICABILITY

The present invention relates to a buckling restrained brace that absorbs an exciting force due to an earthquake or the like, and a load-bearing structure using the buckling restrained brace. According to the buckling restrained brace and the load-bearing structure of the present invention, a first reinforcing member (an end connection plate) is attached on a core material. Thereby, it is possible to suppress the cost increase and improve yield strength and buckling strength at a position on an end portion side of the core material.

DESCRIPTION OF REFERENCE NUMERALS

1: buckling restrained brace
5: core material
6: restraining member
7: end portion lid
8: filler
10: end connection plate (first reinforcing member)
11: bridge plate (second reinforcing member)
P: axis
21: buckling restrained brace
25: core material
30: end connection plate (first reinforcing member)
100: load-bearing structure
105: frame
105*a*: corner portion
106: vertical frame
107: horizontal frame
108: gusset plate (mounting member)
109: slit
110: load-bearing structure

The invention claimed is:

1. A buckling restrained brace comprising:

a core material that extends along an axis and has a plate shape;

a restraining member that extends along the axis and covers the core material from an outer peripheral side in a state where both end portions of the core material in an axis direction protrude outside;

a filler that is filled between the restraining member and the core material; and a pair of first reinforcing members that each have a plate shape and are directly attached on both end portions of the core material in the axis direction so as to interpose the core material therebetween from both sides of the core material in a plate width direction, wherein a pair of the core materials is provided in a state of being positioned away from each other in a plate thickness direction, wherein the buckling restrained brace further comprises second reinforcing members that are disposed between the pair of the core materials only at both end portions of the core materials in the axis direction, thereby connecting the pair of the core materials, and wherein the second reinforcing members are sandwiched by the pair of the core materials from both sides of the second reinforcing members in a plate width direction of the second reinforcing members.

2. A load-bearing structure comprising:

a frame of which an external form has a rectangular frame shape;

a plurality of mounting members provided so as to protrude inward from the frame; and the buckling restrained brace according to claim 1 that is installed between the mounting members opposite to each other, out of the plurality of mounting members, wherein each of the mounting members is formed with slits that extend from end surfaces of the mounting members toward the frame, so that the pair of first reinforcing members is capable of being inserted therein when the buckling restrained brace is installed.

* * * * *